United States Patent [19]

Brockelsby

[11] 3,986,723

[45] Oct. 19, 1976

[54] REMOVABLE BOAT WHEEL SYSTEM

[76] Inventor: Wayne W. Brockelsby, 1625 Margate Ave., Orlando, Fla. 32803

[22] Filed: Dec. 29, 1975

[21] Appl. No.: 644,584

[52] U.S. Cl. ..... 280/47.13 B; 280/414 A; 9/1.2

[51] Int. Cl.[2] ..... B60P 3/10

[58] Field of Search ..... 280/414 R, 414 B, 47.32, 280/47.13 R, 47.13 B, 47.14; 9/1 T

[56] References Cited

UNITED STATES PATENTS

| | | | |
|---|---|---|---|
| 2,999,252 | 9/1961 | Norrby | 280/414 A X |
| 3,052,202 | 9/1962 | Dearborn | 9/1 T X |
| 3,134,111 | 5/1964 | Atwood | 280/414 A X |
| 3,284,821 | 11/1966 | Zoretic | 280/47.32 X |
| 3,295,864 | 1/1967 | Norrby | 9/1 T X |
| 3,370,309 | 2/1968 | Fredelake | 9/1 T |
| 3,697,096 | 10/1972 | Hadley | 280/414 A |

FOREIGN PATENTS OR APPLICATIONS

| | | | |
|---|---|---|---|
| 446,226 | 1/1948 | Canada | 280/414 A |

*Primary Examiner*—M. H. Wood, Jr.
*Assistant Examiner*—R. Schrecengost
*Attorney, Agent, or Firm*—Duckworth, Hobby, Orman, Allen & Pettis

[57] ABSTRACT

Removable boat wheel system for coupling a plurality of rotatable wheel assemblies to a boat for facilitating the overland transportation thereof. Each of the wheel assemblies includes a strut having spaced first and second ends, with the first end movably coupled to either the port or starboard side of the hull of the boat. A wheel is rotatably coupled to the second end of the strut. The wheel assembly also includes a support arm having spaced first and second ends, with the first end coupled to the boat forward of the first end of the strut. The second end of the support arm is movably coupled to the strut adjacent the second end thereof in such a manner that the location of the strut may be reversed between a first and second position for facilitating the overland transportation of the boat. The first position corresponds to the wheel and the strut depending generally downward below a bottom section of the boat for transporting the boat in a cockpit-up orientation. The second position corresponds to the wheel and the strut depending in a direction opposite the first position for transporting the boat in a cockpit-down orientation. The wheel assemblies are located slightly forward of a rear transom section of the boat and slightly to the rear of the center of mass of the boat, whereby the mass of the stern section of the boat partially counterbalances the mass of the bow section of the boat.

20 Claims, 7 Drawing Figures

REMOVABLE BOAT WHEEL SYSTEM

BACKGROUND OF THE INVENTION

1. Field of the Invention

This invention relates to new and useful improvements for detachable wheel systems for coupling to a small boat for facilitating the launching and recovery of the boat in water and the transportation of the boat overland. The wheels may be adjusted to various positions suitable for land transportation and for water travel.

2. Description of the Prior Art

The prior art is replete with examples of detachable boat wheel systems which are manufactured for long distance transportation, but which are unsuitable for only intermittent use because of their complicated mechanical structure and their concommitant cost of manufacture. Sanborn in U.S. Pat. No. 2,664,577 discloses a wheel system having a frame support for transporting the boat along the highway. The frame includes means for swinging the wheel and its supporting strut out of the way when the boat is afloat. However, the Sanborn wheel system includes a mechanical support manufactured in a fixed manner which cannot be adjusted for transporting the boat in both the normal and inverted positions.

Fredelake, in U.S. Pat. No. 3,370,309, discloses a wheel system for being detachably coupled between each of a pair of rotating wheels and means for independently suspending the wheels to absorb road shock. The wheel system may be raised to a retracted position when the boat is afloat. Bemis, in U.S. Pat. No. 3,035,282, discloses a retractable wheel system for coupling to a small boat, with the wheels being retractable into the internal volume of the boat which is normally occupied by the pilot thereof. The retractable boat wheels disclosed by Hadley, in U.S. Pat. No. 3,697,096, are likewise inconvenient because a cradle bar interferes with an outboard motor depending adjacent thereto during launching and recovery. Other retractable wheel systems for coupling to small transportable boats are disclosed by Norrby in U.S. Pat. No. 3,295,864; Atwood in U.S. Pat. No. 3,134,111; Dearborn in U.S. Pat. No. 3,052,202; Norrby in U.S. Pat. No. 2,999,252; and Hadley in U.S. Pat. No. 3,697,096.

The primary object of the present invention is to provide a detachable wheel system to facilitate the water launching and recovering, as well as the transportation overland, of a small transportable boat. The wheel system must be very simple and easily manufactured at a cost which will allow the wheel system to be economically installed on small boats intended to be transported on the tops of cars, trucks or other land vehicles. The wheel system may be structured of light weight materials since its primary purpose is to facilitate short distance transportation, such as between a motor vehicle and a launching ramp or from the owner's home to a nearby body of water. The mechanical structure of the wheel system must be easy to install, capable of quick detachment, and adjustable using only readily available tools. The wheel system must be constructed of light weight materials to prevent the alteration of the buoyant balance of the boat.

The wheel system must be reversible so that the boat may be transported either in the normal open-side-up position or in a reversed position with the open-side down. The wheels must provide adequate ground clearance for the boat in either of these transporting positions. Furthermore, the wheel system must be adjustable to allow for minimum water and air resistance when the boat is traveling through water. The wheel system must be relatively impervious to water for allowing the wheels to be used for launching the boat, such as rolling down an inclined boat ramp. The wheel system is mounted forward of the transom section so that the weight of the boat forward of the wheel system may counterbalance the weight of the boat, and the motor attached thereto, aft of the wheel mounting position. It must be possible for the user to adjust the position of the wheel system from his normal boat operating position without detaching the wheel from the boat, so as to prevent the loss of the wheel during this adjustment.

SUMMARY OF THE INVENTION

A removable boat wheel system for coupling a plurality of rotatable wheel assemblies to a boat for facilitating the overland transportation thereof. Each of the wheel assemblies includes a strut having spaced first and second ends, the first end movably coupled to one of the port or starboard sides of a hull of the boat. A wheel is rotatably coupled to the second end of the strut. Each of the wheel assemblies further includes a support arm having spaced first and second ends, the first end being coupled to the boat forward of the first end of the strut. Reversing means are included for movably coupling the second end of the support arm to the strut, adjacent the second end thereof, for enabling the strut and the wheel attached thereto to rigidly assume a first or a second position for facilitating the overland transportation of the boat. The first position corresponds to the wheel and the strut depending generally downward below a bottom section of the boat for facilitating the overland transportation of the boat in a cockpit-up orientation. The second position corresponds to the strut and the wheel depending in a direction opposite the first position for facilitating the overland transportation of the boat in a cockpit-down orientation.

In a first preferred embodiment of the present invention one pair of the rotatable wheel assemblies is coupled to the hull of the boat slightly forward of the rear transom section thereof, whereby the weight of the stern of the boat, and anything attached thereto, partially counterbalances the weight of the bow of the boat.

THE DRAWINGS

Other objects, features and advantages of this invention will be apparent from a study of the written description and the drawings in which.

DETAILED DESCRIPTION OF THE PREFERRED EMBODIMENT

Figure 1:
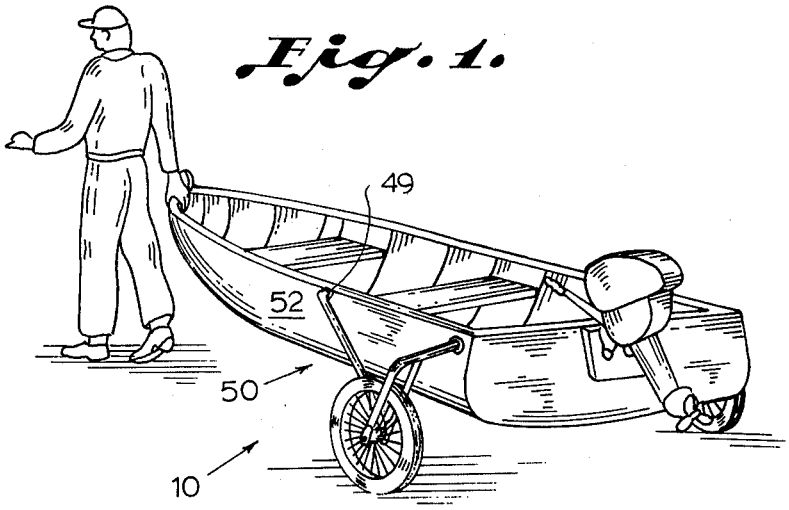
FIG. 1 illustrates the removable boat wheel system rigidly attached in a first position to a small, transportable boat.

The removable boat wheel system includes a plurality of rotatable wheel assemblies, shown generally as 10 in FIGS. 1 through 7. With specific reference to FIGS. 5 and 7, each of the wheel assemblies includes a strut 20 which is constructed of a first outside member 24 and a second inside member 26. A first end 21 of the strut 20 has the outside member 24 bent at a right angle toward the inside strut 26 which is welded or fastened thereto.

A wheel 30 is rotatably coupled between the distended ends of the outside member 24 and the inside member 26, both of which form a second end 22 of the strut 20, by an axle bolt 76. A or second end of a support arm 40 is rotatably coupled (reversing about a reversing bolt 45, which in turn couples to the open mouth section 78 at the second end of the inside member 26 of the strut 20. A first end 41 of the support arm 40 is bent at a right angle to couple within an aperture or sleeve 49 (comprising the support arm restraining means) in the hull 52 of the boat 50. The aperture 49 is located generally forward of the first end 21 of the strut 20 and preferably just below the gunwale section of the boat 50. A hitchpin 47 communicates through the first end 41 for restraining the support arm 40 between the aperture 49.

Figure 4:
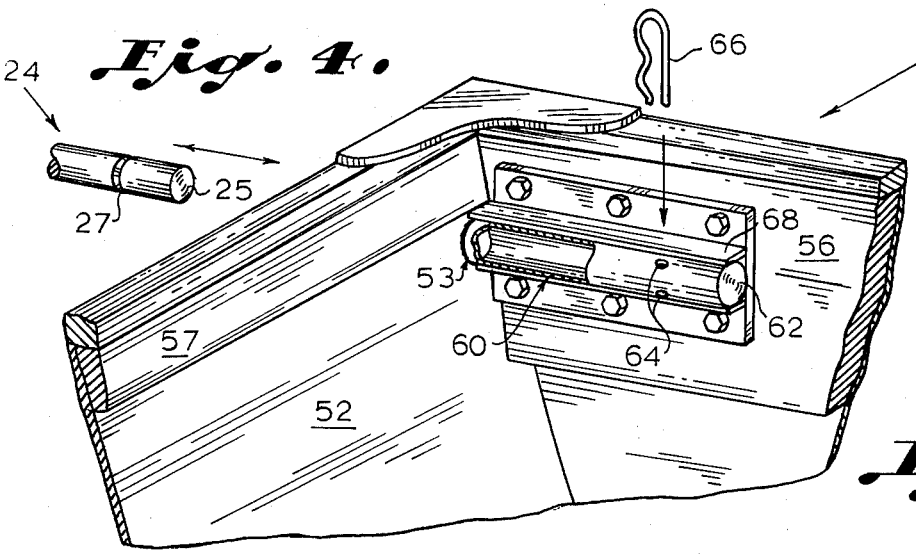
FIG. 4 illustrates the first pivot means for attaching the strut to the port or starboard side of the boat.

With reference to FIG. 4, a first, generally cylindrical sleeve 60 includes a first open end for communicating through an aperture 53 in the hull 52 of the boat 50. The first sleeve 60 communicates along its length within a channel in a support block 68 which is coupled to a rear transom section 56 of the boat 50. A closed end 62 is included in the first sleeve 60 to prevent water from splashing through the sleeve and into the cockpit of the boat. One end of a hitch pin 66 (restraining means) communicates through a pair of generally aligned holes 64 in the first sleeve 60 and through an adjacent annular groove 27 in a first pivot shaft section 25 of the outside member 24. The hitch pin 66 allows the first pivot shaft section 25 of the strut 20 to rotate in a plane which is generally parallel to a longitudinal axis of the boat, which is typically the direction of travel of the boat as it is transported upon land. The first pivot shaft section 25 of the strut 20 further includes a shield 38 attached perpendicularly thereto for communicating over the aperture 53 within the hull 52 of the boat 50 for preventing water from entering the first sleeve 60. As used in the foregoing description, the term "hull" includes not only the outside surface of the boat but also all of the interior supports and reinforcements lending shape to the hull.

Figure 5:
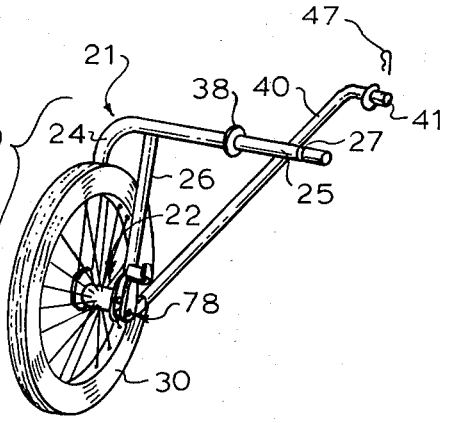
FIG. 5 illustrates a first preferred embodiment of the strut, the wheel and the support arm coupled thereto.
Figure 7:
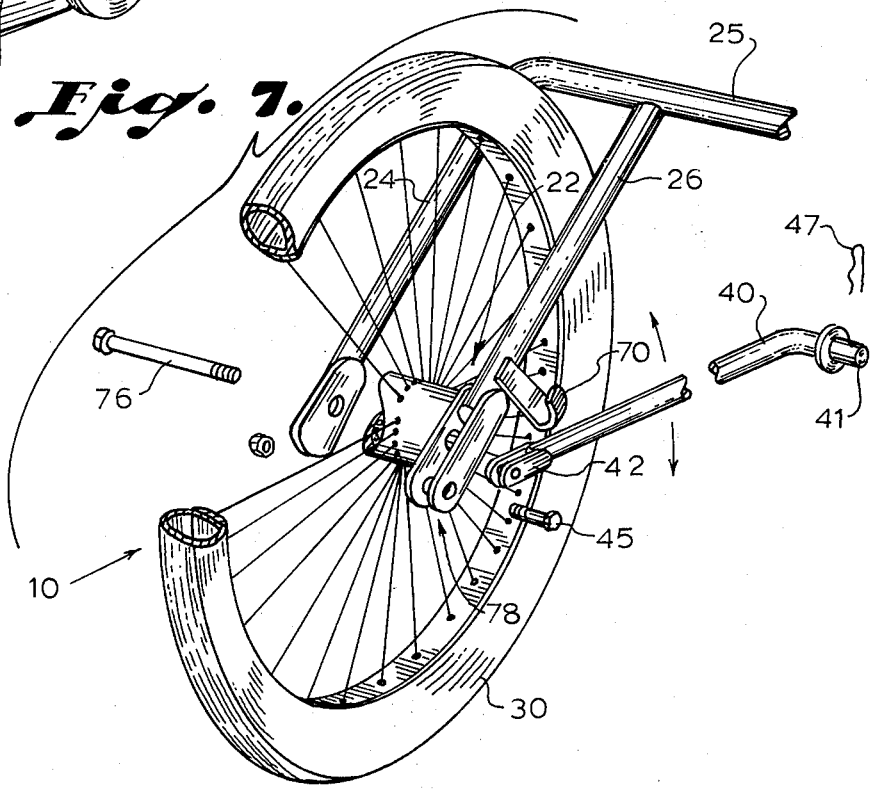
FIG. 7 illustrates the reversing means for enabling the strut to rigidly assume the first, second or third positions.

It should be noted that while FIGS. 5 and 7 represent wheel assemblies intended to be attached to a port side of the boat 50, a mirror image wheel assembly will be required for coupling to the starboard side of the boat 50. The two wheel assemblies will be paired with each other in that the first sleeve 60 of each wheel assembly will be spaced along a line generally perpendicular to the longitudinal axis of the boat. The imaginary line including the first sleeve 60 of the paired wheel assemblies will be slightly forward of the rear transom section 57 of the boat 50 and, as shown in FIG. 1, the strut 20 will be canted into a slightly forward position by the support arm 40 so that the weight of the stern of the boat, and any motor or other attachments coupled thereto, will partially counterbalance the weight of the bow of the boat.

Figure 2:
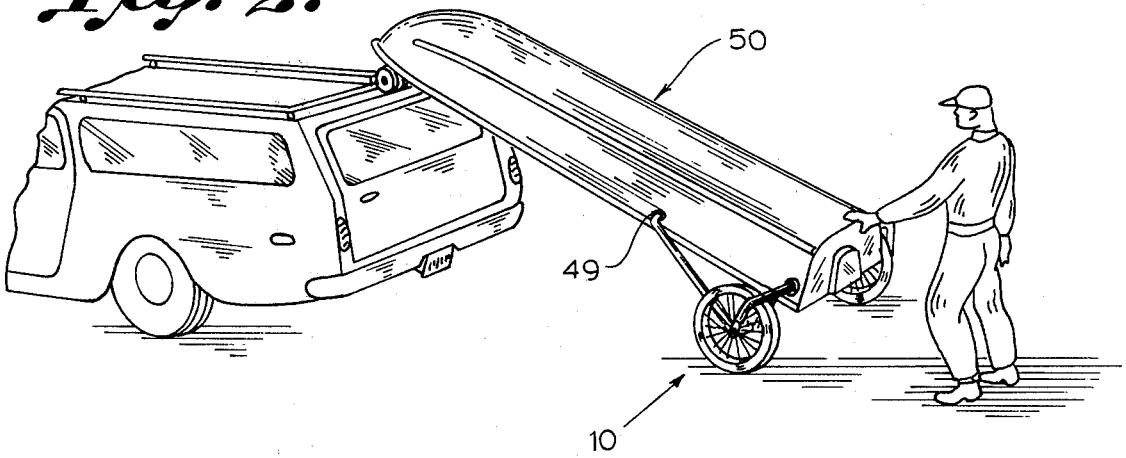
FIG. 2 illustrates the removable boat wheel system rigidly attached in a second position to the boat.
Figure 3:
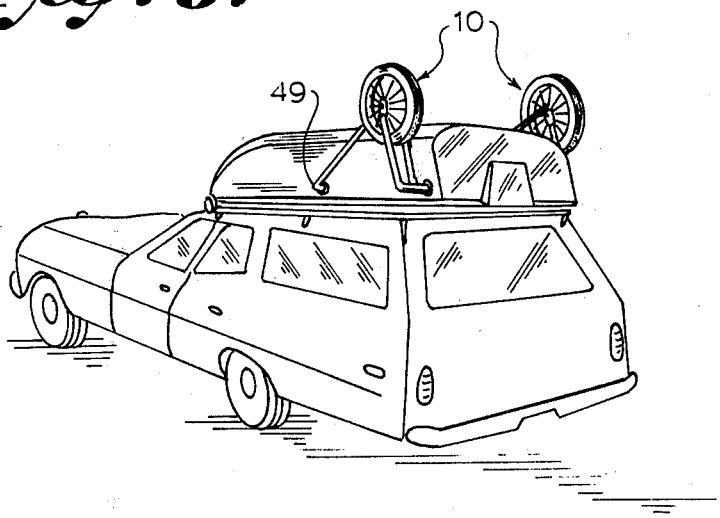
FIG. 3 illustrates a removable boat wheel system rigidly attached in the first position to the boat.

With further reference to FIG. 7, the wheel 30 rotates freely about the axle bolt 76 communicating between the second end of the outside member 24 and the open mouth section 78 at the second end of the inside member 26 of the strut 20. The second end 42 of the support arm 40 is movably coupled by the reversing bolt 45 within the open mouth section 78 at the second end of the inside member 26 of the strut 20. This pivotal coupling of the support arm 40 provides a rigid support for the second end 22 of the strut 20 as it assumes either the first or the second transporting positions. In the first position, as shown in FIGS. 1 and 3, the wheel 30 and the strut 20 depend generally downward below the gunwale 57 and the bottom sections of the boat for providing ground clearance when the boat is transported in a cockpit-up orientation. This orientation provides additional space within the cockpit for storage of fishing gear, life preservers, etc. The second position, as shown in FIG. 2, corresponds to the wheel 30 and the second end 22 of the strut 20 depending above the gunwale 57 and bottom sections of the boat, in a direction generally opposite from the first position, for allowing the boat to be transported in a cockpit-down orientation, such as for loading the boat onto a car-top carrier.

Figure 6:
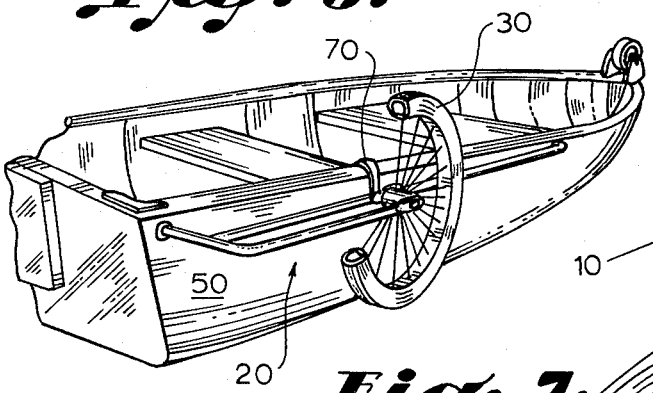
FIG. 6 illustrates the removable boat wheel system attached in a third position to the boat.

As shown in FIGS. 6, and 7, a hook 70 (storage means) is coupled to the inside member 26 of the strut 20, adjacent the second end 22 thereof, for detachably engaging the gunwale section 57 of the boat 50. This enables the wheel 30, the strut 20 and the support arm 40 to be stored alongside the hull 52 of the boat 50, at a position generally parallel to the gunwale section 57. In this third position, the distended end of the support arm 40 may be either hooked over the gunwale section 57 of the boat or may be inserted into another aperture designed to restrain the movement thereof.

Small boats are often transported with the open-cockpit side communicating with the top of a station wagon, truck or other powered vehicle suitable for transporting the boat overland. The wheel assemblies 10 of the removable boat wheel system may be stored either in the down and extended first position, as shown in FIG. 3, or in the alternative, the wheel assemblies may be stored in the third position shown in FIG. 6. When the operator desires to launch the boat, he pulls the stern of the boat partially off of the rear end of the land transporting vehicle and attaches the wheel assemblies 10 as shown in FIG. 2. This is accomplished by inserting the first pivot shaft 25 of the strut 20 into the first sleeve 60 and then inserting the hitch pin 66 through the holes 64, thereby engaging the annular groove 27. This allows the wheel assembly 10 rotate about the first pivot shaft 25 within the first sleeve 60 so that the wheel 30 and the strut 20 may be shifted between the first, the second and the third positions. As shown in FIG. 2, the wheel assemblies 10 have been inserted for transporting the boat 50 in the cockpit down orientation and the boat is in the process of being removed from the top of the transporting vehicle. After the first end 41 of the support arm 40 is inserted into the aperture 49 and secured therein by the hitch pin 47, the operator may then grasp the bow of the boat 50 and easily transport the boat along the ground surface to a convenient area for installing other nautical accessories. Once this location is reached, the operator may simply rotate the boat on the wheels until the bottom section of the boat rests upon the ground leaving the wheel assemblies 10 depending upwardly above the gunwale section.

The wheel assemblies 10 may then be changed from the second position to the first position, as shown in FIG. 1, by merely detaching hitch pin 47, removing the first end 41 of the support arm 40 from the aperture 49, rotating the strut 20 about the first pivot shaft section 25 until the first end 41 of the support arm 40 may be once again inserted into the aperture 49. The hitch pin 47 may then be reattached to the first end 41 of the support arm 40. In this first position the strut 20 depends generally downwardly below the bottom section of the boat 50 for transporting the boat in a cockpit-up position. Next, the operator may install the nautical accessories, such as the motor, gas tank, fishing accessories and so forth. Since these nautical accessories are usually mounted toward the stern section of the boat, their added weight will act to counterbalance the mass of the bow of the boat, thereby making it easier for the operator to lift the bow of the boat and transport the boat in a cockpit-up orientation, as shown in FIG. 1. The operator may then simply pull the boat to the launching ramp and launch the boat in a normal manner, that is with the stern section first. The wheel assemblies 10 will generally be submerged once the boat is buoyantly supported in the water. The operator then positions himself inside the stern section of the boat and by merely removing the first end 41 from the aperture 49 the wheel assemblies 10 may be rotated into the third position as shown in FIG. 6. In the alternative, the wheel assemblies may be rotated into the second position as shown in FIG. 2. Also, the wheel assemblies may be completely removed from their mounting position external to the hull 52 of the boat 50 by simply releasing the hitch pin 66 which communicates through the annular groove 27 of the first pivot shaft 25 of the strut 20. When the first end 41 of the support arm 40 is removed from the aperture 49, each of the wheel assemblies may be manually placed within the cockpit of the boat pending further use. Of course, the reattachment and use of the wheel assemblies during the docking and loading process is just the reverse of the previously explained procedures.

It will be clear at this point that a removable boat wheel system has been provided which overcomes some of the problems of prior boat wheel assemblies. However, this invention is not to be construed as limited to the particular forms disclosed herein since these embodiments are to be regarded as illustrative rather than restrictive.

I claim:

1. A removable boat wheel system for coupling a plurality of rotatable wheel assemblies to a boat, each of said wheel assemblies comprising in combination:

a strut having spaced first and second ends, said first end movably coupled to one of the port or starboard sides of the hull of said boat;

a wheel rotatably coupled to said second end of said strut;

a support arm having spaced first and second ends, said first end coupled to said boat forward of said first end of said strut; and reversing means for coupling said second end of said support arm to said strut adjacent said second end thereof for enabling said strut and said wheel attached thereto to rigidly assume a first or a second position for facilitating the overland transportation of said boat, said first position corresponding to said wheel and said strut depending generally downwardly below a bottom section of said boat for providing sufficient ground clearance when transporting said boat in a cockpit-up orientation, and said second position corresponding to said wheel and said strut depending in a direction opposite said first position for providing sufficient ground clearance when transporting said boat in a cockpit-down orientation.

2. The removable boat wheel system as described in claim 1 including first pivot means coupled between said first end of said strut and one of said port or starboard sides of said hull of said boat for providing a movable coupling therebetween.

3. The removable boat wheel system as described in claim 2 wherein said first pivot means allows the rotation of said strut about said first end thereof in a plane generally parallel with a longitudinal axis of said boat.

4. The removable boat wheel system as described in claim 2 wherein said first pivot means comprises in combination:

a first sleeve for being coupled to one of said port or said starboard sides of said hull of said boat; and a first pivot shaft having one end for rotatably communicating within said first sleeve and another end thereof for coupling with said first end of said strut.

5. The removable boat wheel system as described in claim 4 wherein said first sleeve is mounted generally perpendicular to said longitudinal axis of said boat.

6. The removable boat wheel system as described in claim 4 wherein said first pivot means further includes restraining means for restraining the longitudinal motion of said first pivot shaft within said first sleeve without restraining the rotational communication therebetween.

7. The removable boat wheel system as described in claim 6 wherein said restraining means comprises a removable hitch pin for communicating through bores in said first sleeve and coupling within an annular groove of said first pivot shaft therein.

8. The removable boat wheel system as described in claim 2 wherein said reversing means comprises:

a second pivot shaft coupled to said strut generally adjacent said second end thereof; and rotation means interposed between said second pivot shaft and said second end of said support arm for enabling rotational motion therebetween.

9. The removable boat wheel system as described in claim 8 wherein said second pivot shaft is generally perpendicular to said longitudinal axis of said boat.

10. The removable boat wheel system as described in claim 8 further including storage means for enabling said strut and said wheel attached thereto to rigidly assume a third position corresponding to said strut depending generally parallel with said longitudinal axis of said boat and generally forward of said first pivot means.

11. The removable boat wheel system as described in claim 10 wherein said storage means comprises:

a hook coupled to said strut for detachably engaging a gunwale section of said boat; and means for storing said support arm generally parallel with said gunwale section of said boat.

12. The removable boat wheel system as described in claim 8 further including support arm restraining means interposed between said first end of said support arm and said hull of said boat for restraining the motion therebetween when said strut is in said first position or said second position.

13. The removable boat wheel assembly as described in claim 8 wherein said rotatable wheel assemblies are coupled to said boat in pairs, with at least one rotatable wheel assembly on said port side and at least another rotatable wheel assembly on said starboard side of said hull.

14. The removable boat wheel assembly as described in claim 13 wherein said paired rotatable wheel assemblies are spaced on said hull of said boat along a line perpendicular to said longitudinal axis thereof.

15. The removable boat wheel assembly as described in claim 14 wherein one pair of said rotatable wheel assemblies is slightly forward of a rear transom section thereof, whereby the weight of said stern of said boat, and any motor attached thereto, partially counterbalances the weight of the bow of the boat.

16. A removable boat wheel system for coupling a plurality of rotatable wheel assemblies to a boat, each of said wheel assemblies comprising in combination:

a strut having spaced first and second ends;

a wheel rotatably coupled to said second end of said strut;

first pivot means for coupling said first end of said strut to said boat adjacent one of the port or starboard sides of a hull of said boat at a point slightly forward of a rear transom section thereof;

a support arm having spaced first and second ends, said first end removably coupled to said boat forward of said first end of said strut; and reversing means for movably coupling said second end of said support arm to said strut adjacent said second end thereof for enabling said strut and said wheel attached thereto to rigidly assume a first or second position for facilitating the overland transportation of said boat, said first position corresponding to said wheel and said strut depending generally downward below a bottom section of said boat for providing sufficient ground clearance when transporting said boat in a cockpit-up position, and said second position corresponding to said wheel and said strut depending in a direction opposite said first position for providing sufficient ground clearance when transporting said boat in a cockpit-down orientation.

17. The removable boat wheel system as described in claim 16 wherein said reversing means comprises:

a reversing pivot shaft coupled to said strut adjacent to said second end thereof, said reversing pivot shaft being generally perpendicular to a longitudinal axis of said boat; and rotation means interposed between said reversing pivot shaft and said second end of said support arm for enabling rotational motion therebetween.

18. The removable boat wheel system as described in claim 17 wherein said rotatable wheel assemblies are coupled to said boat in pairs, with one of said rotatable wheel assemblies on said port side and another of said rotatable wheel assemblies on said starboard side of said hull.

19. The removable boat wheel system as described in claim 18 wherein said paired wheels of said paired rotatable wheel assemblies are spaced external to said hull along a perpendicular to a longitudinal axis thereof, said perpendicular being located slightly astern of a center mass of said boat, whereby the mass of said stern section of said boat partially counterbalances the mass of a bow section of said boat.

20. The removable boat wheel assembly as described in claim 18 wherein said first pivot means comprises in combination:

a first sleeve for being coupled to said boat adjacent one of said port or said starboard sides of said hull, said first sleeve oriented generally perpendicular to said longitudinal axis of said boat; and a first pivot shaft having one end for rotatably communicating within said first sleeve and another end thereof for coupling with said first end of said strut.

* * * * *